US011952682B2

(12) United States Patent
Benelli

(10) Patent No.: US 11,952,682 B2
(45) Date of Patent: Apr. 9, 2024

(54) COTTON-BASED ELASTICISED YARNS TO MAKE ENVIRONMENT-FRIENDLY ELASTICISED FABRICS

(71) Applicant: CANDIANI S.P.A., Robecchetto con Induno (IT)

(72) Inventor: Paolo Benelli, Prato (IT)

(73) Assignee: CANDIANI S.P.A., Robecchetto County Induno (IT)

( * ) Notice: Subject to any disclaimer, the term of this patent is extended or adjusted under 35 U.S.C. 154(b) by 311 days.

(21) Appl. No.: 17/288,464

(22) PCT Filed: Sep. 17, 2019

(86) PCT No.: PCT/IB2019/057825
§ 371 (c)(1),
(2) Date: Apr. 23, 2021

(87) PCT Pub. No.: WO2020/084361
PCT Pub. Date: Apr. 30, 2020

(65) Prior Publication Data

US 2021/0388538 A1 Dec. 16, 2021

(30) Foreign Application Priority Data

Oct. 25, 2018 (IT) ..... 102018000009802

(51) Int. Cl.
*D02G 3/32* (2006.01)
*D02G 1/02* (2006.01)
(Continued)

(52) U.S. Cl.
CPC ..... *D02G 3/322* (2013.01); *D02G 1/0293* (2013.01); *D02G 3/286* (2013.01); *D02G 3/288* (2013.01); *D02G 3/36* (2013.01); *D10B 2321/02* (2013.01)

(58) Field of Classification Search
CPC ..... D02G 3/322; D02G 3/36; D02G 3/38; D02G 3/32; D02G 3/328; D02G 3/22;
(Continued)

(56) References Cited

U.S. PATENT DOCUMENTS 1,868,690 A * 7/1932 Brigham ..... D02G 3/32 66/190
2,231,808 A * 2/1941 Augustin ..... D03D 15/56 57/248
(Continued)

FOREIGN PATENT DOCUMENTS

EP 2 638 192 B1 5/2016
EP 2 145 034 B1 11/2016
(Continued)

*Primary Examiner* — Khoa D Huynh
*Assistant Examiner* — Uyen T Nguyen
(74) *Attorney, Agent, or Firm* — Maschoff Brennan

(57) ABSTRACT

A method for making an elastic core yarn includes covering an elastic core having a fiber of natural rubber with metric count 200-1000 dtex with a cotton-based covering yarn. The elastic core and the covering yarn are conveyed such that the covering yarn laterally attains a proximity of the elastic core in a wrapping space. The covering yarn is helically wrapped about the elastic core. The conveying speed, and therefore the winding/unwinding speed, is selected such that the elastic core is stretched to a stretching ratio of at least two, and the covering yarn becomes twisted with a final twist direction opposite to its initial twist direction, and forms T coils per length unit of the elastic fiber set between a minimum value T0 and a maximum value T1. An elasticized yarn is thereby obtained, and a fabric, in particular a denim type fabric, is manufactured from this yarn.

20 Claims, 4 Drawing Sheets

(51) Int. Cl.
*D02G 3/28* (2006.01)
*D02G 3/36* (2006.01)

(58) Field of Classification Search
CPC ..... D02G 3/00; D02G 3/286; D02G 3/288; D02G 3/28; D02G 3/26; D02G 1/02; D02G 1/0293; D02G 1/0286; D02G 1/00
See application file for complete search history.

(56) References Cited

U.S. PATENT DOCUMENTS 2,263,612 A 11/1941 Chittenden
2,300,241 A * 10/1942 Van Voorhis ..... D02G 3/328 57/225
2,397,460 A * 4/1946 Bell ..... D02G 3/46 428/371
2,574,737 A * 11/1951 Goodchild ..... D02G 3/32 66/189
2,587,117 A * 2/1952 Clay ..... D02G 3/322 66/193
2,992,150 A 7/1961 Goy
3,013,379 A * 12/1961 Breen ..... D02G 1/165 28/271
3,038,295 A * 6/1962 Humphreys ..... D02G 3/324 57/227
3,380,244 A 4/1968 Martin
3,866,444 A * 2/1975 Levin ..... D04B 21/18 66/195
10,638,765 B2 * 5/2020 Mercuri ..... B65D 29/04
2005/0165193 A1 * 7/2005 Patel ..... D02G 3/328 264/235.6
2008/0268734 A1 * 10/2008 Tharpe ..... D02G 3/328 57/226
2013/0251974 A1 * 9/2013 Benelli ..... D02G 3/322 428/222
2013/0260129 A1 * 10/2013 Agzikara ..... D01H 5/70 428/221
2020/0299871 A1 * 9/2020 Yenici ..... D04B 1/18

FOREIGN PATENT DOCUMENTS

FR 1 600 741 A 7/1970
GB 827 561 A 2/1960

* cited by examiner

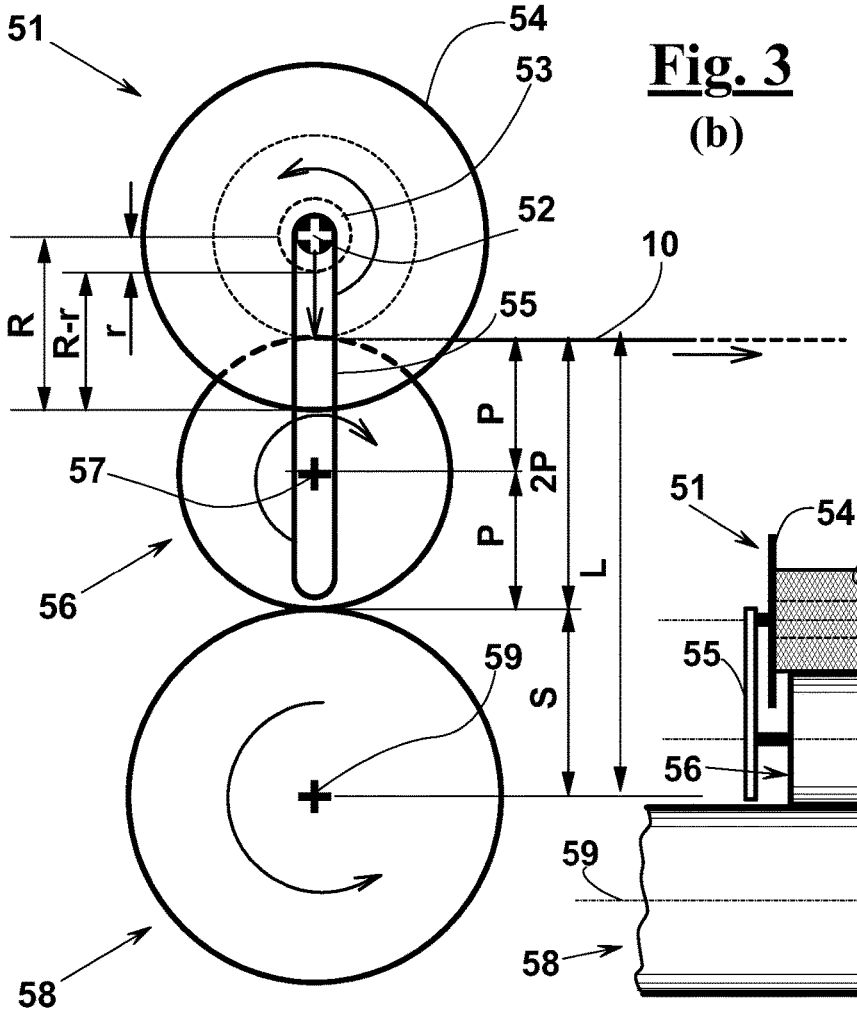
Fig. 3
(b)
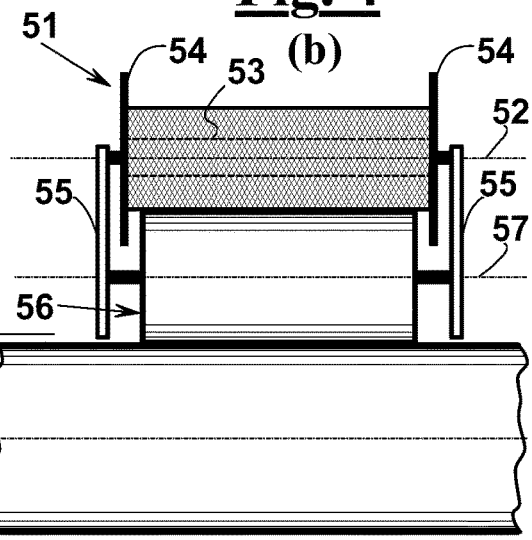
Fig. 4
(b)
Fig. 5
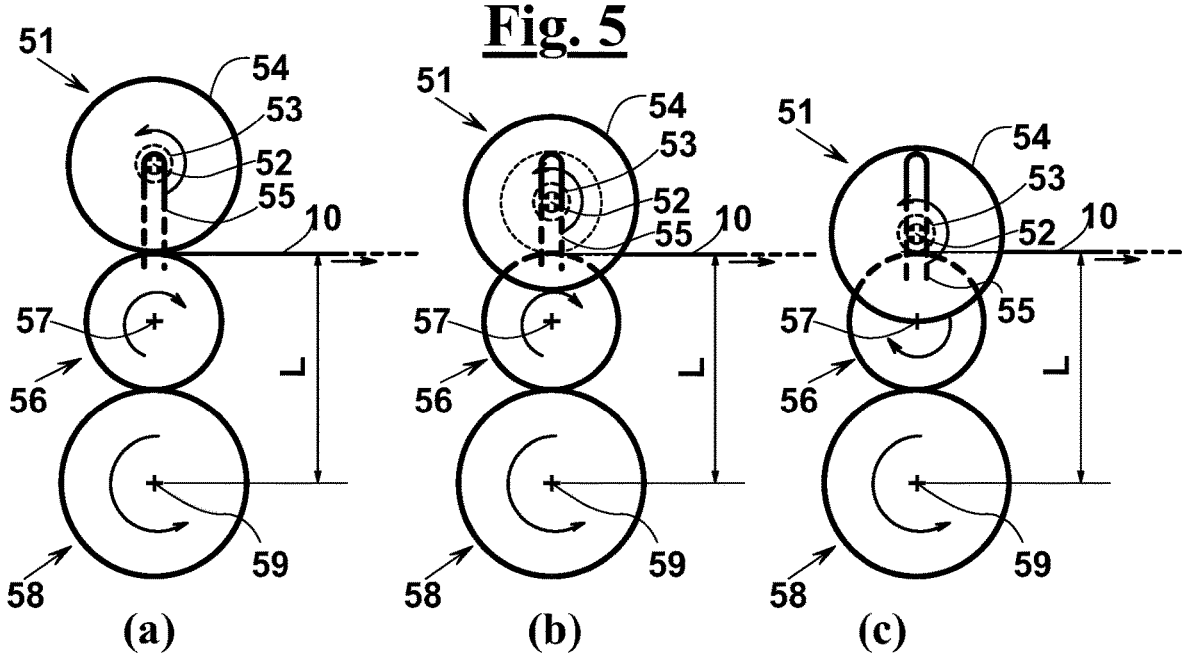

COTTON-BASED ELASTICISED YARNS TO MAKE ENVIRONMENT-FRIENDLY ELASTICISED FABRICS

FIELD OF THE INVENTION

The present invention relates to a method for making cotton-based elasticised yarns, and also relates to environment-friendly elasticised fabrics made therefrom.

BACKGROUND OF THE INVENTION—TECHNICAL PROBLEMS

Elasticised fabrics are used in a wide range of applications. In particular, elasticised fabrics are used to manufacture garments that do not hinder the movements of the user's limbs, or conform themselves to these movements, which generates a comfort sensation to the user. This feature is particularly appreciated in underwear clothing or in sport and gym clothes, but is also useful in everyday-life situations such as sitting in a car, walking, and whenever the joints are bent. Elasticised fabrics are also advantageously used to make tight coverings for rounded objects, e.g. sofa and armchairs coverings.

The features of an elasticised fabrics depend on the high elasticity of the elasticised yarns used for their manufacture. For instance, U.S. Pat. Nos. 2,992,150, 3,380,244, EP 2 145 034 and EP 2 638 192 describe elasticised ring-spun yarns, or the like, in which an elastic filament is surrounded by a fibrous sheath comprising a mass of synthetic or natural staple fibres. In a few cases, cotton fibres are used.

Moreover, denim-type elasticised fabrics have been known and appreciated for some years. By these fabrics, the above-mentioned advantages of elasticised fabrics could be extended to jeans garments. For example, EP 2 145 034 and EP 2 638 192 relate to these fabrics.

However, the elastic threads conventionally used to make elasticised yarns are made of synthetic materials, in particular the above-mentioned patent literature relates to polyurethane or polyolefin elastic materials. Therefore, the articles comprising fabrics made from cotton and elastic thread cannot be easily disposed, in particular they cannot be disposed by composting. Moreover, the synthetic elastic thread can be allergenic to some skin-sensitive people wearing garments manufactured from fabrics containing them.

In order to mitigate the above drawbacks, an alternative to synthetic elastic threads could be the use of natural rubber elastic threads. However, currently available natural rubber threads have a linear mass density too high to be used to make elasticised yarns by currently-preferred spinning techniques, such as ring-spinning or open-end spinning, since the commercially available equipment can only accept very thin elastic thread.

SUMMARY OF THE INVENTION

Therefore, the present invention aims at providing a method for making an elasticised yarn from an elastic fibre and a cotton-based yarn in which a natural rubber fibre can be used as the elastic fibre, said natural rubber fibre having a metric count as commercially available, thus overcoming the above mentioned limitations of the conventional spinning methods.

Moreover, it is an object of the invention to provide a method for making such an elasticised yarn by which elasticised fabrics can be made that are free from problems due to poor elastic recovery of the elasticised yarn, e.g.

inelastic deformities formed after stretching and then releasing the fabric, even during manufacture and normal use of garments and other articles made therefrom.

Moreover, it is a particular object of the present invention to provide a method for making an elasticised yarn in which the elastic thread can be unwound from a spool comprising end-flanges and can be delivered to a processing unit at a fixed stretching ratio, without having to periodically adjust the tensile force acting on the elastic thread.

It is another particular object of the invention to provide such an elasticised yarn and a denim-type fabric made therefrom.

The above objects are achieved by a yarn and a fabric.

According to the invention, a method for making an elastic core yarn comprises the steps of:

- prearranging a source of an elastic core comprising an elastic fibre made of a natural rubber, i.e. a rubber fibre obtained by extruding a natural latex containing more than 80% of cis-1,4-polyisoprene, wherein the elastic fibre has a linear mass density set between 200 dtex and 1000 dtex;
- prearranging at least one covering yarn comprising cotton at a weight percentage higher than 50%, wherein the covering yarn has a linear mass density set between 6 Nm and 100 Nm, said covering yarn twisted with an initial twist direction selected between "Z" and "S";
- conveying the elastic core and said covering yarn up to a collecting spool, at respective predetermined conveying speeds, wherein the conveying speed of the elastic core ranges
  - from an initial speed, at the source of elastic core,
  - to a final speed at least twice the initial speed, at the collecting spool,
  - wherein said step of conveying is carried out in such a way that the covering yarn laterally attains a proximity of the elastic core in a wrapping space;
- helically wrapping the covering yarn about the elastic core in the wrapping space, thus obtaining the elastic core yarn;

wherein the conveying speeds are selected in such a way that, in the step of helically wrapping:

- the covering yarn becomes twisted with a final twist direction opposite to the initial twist direction, i.e. selected between "S" and "Z", respectively;
- a number T of coils of the covering yarn set between a predetermined minimum value $T_0$ and a predetermined maximum value $T_1$, the minimum and maximum values $T_0$,$T_1$ depending upon the linear mass density Nm, is wrapped about one length unit of the elastic core yarn, wherein the wrapping space is a protected space enclosed by a container.

The elasticized yarn according to the invention, in which elasticity is provided by a natural rubber thread having a linear mass density as high as currently available in the trade, is an elastic core yarn, and not a yarn obtained by such spinning techniques as ring-spinning or open-end spinning, as suggested by the cited prior art. The invention, as disclosed above, solves some typical issues that could otherwise be involved in the manufacture of elastic core yarns, as explained below.

The covering yarn as prearranged can initially be Z-twisted, which is the commercially most available twist direction. According to the invention, the wrapping step is carried out in such a way that, while forming coils about the elastic core, the covering yarn is counter-twisted, i.e. it is twisted in the direction opposite to the initial twist direction, decreasing at first the number of Z-twists to zero and then creating a predetermined number of S-twists per length unit of the elastic core yarn. In this case, the initial or first twist direction is "Z", and the last or second twist direction is "S". As an alternative, of course, the covering yarn can initially be S-twisted, and the wrapping step is carried out in such a way that, while forming coils about the elastic core, the covering yarn is counter-twisted, at first decreasing the number of S-twists to zero and then creating a predetermined number of Z-twists per length unit of the elastic core yarn. In this case, the initial i.e. the first twist direction is "S" and the last i.e. the second twist direction is "Z".

This way, while being wrapped about the elastic core, the covering yarn loses at first the twists in the initial twist direction, for example Z-twists, and then receives twists in the opposite direction, in this example, S-twists. On the contrary, if the wrapping step were carried out by increasing the number of twists in the initial twist direction, the covering yarn would soon become too "tight", and would be likely to break before an appropriate, desired number of coils is wrapped about the elastic core.

Therefore, the method according to the invention makes it possible to form a larger number of coils per length unit of the elastic core yarn, without dangerously approaching or reaching a critical stability limit of the covering yarn, and preventing any risk of breaking the elastic core yarn, due to an excessive torsion level.

With a number of coils per unit length higher than said minimum value, a coil structure is obtained that is packed tightly enough to force the coils to perform a substantially regular elastic recovery. Therefore, a large number of coils per length unit, and the resulting highly packed structure that can safely be reached by the method according to the invention, causes the coils to substantially return to their original unstreched configuration, once the yarn has been stretched and then released. This prevents the elastic core thread from penetrating between adjacent coils of the covering yarn while being stretched, and from remaining in a protruded state from the elastic core yarn, after being released, which would remarkably deteriorate the look of any fabric manufactured from the elastic core yarn, as well as its elastic properties.

Moreover, with the method according to the invention, the covering yarn, after losing the twists in the initial twist direction and before receiving any twists in the final twist direction, crosses a zero-torsion condition, in which the discontinuous cotton fibres, and possible fibres of a different material, have a small or even no cohesion. As well known, the cohesion between the fibres and therefore the strength of the articles made of discontinuous fibres is mainly ensured by twisting such fibres together so as to obtain a yarn. In the zero-torsion condition provided by this method, a possible disgregation of the covering yarn while being wrapped about the elastic core could be an issue.

However, the protection of the wrapping space provided by the container, limits or substantially suppresses the friction of the covering yarn with air, thus averting the risk of disgregating the covering yarn when it crosses the above-mentioned zero-torsion condition.

Therefore, by the method according to the invention, it becomes possible to use an elastic natural rubber thread having a linear mass density as currently available in the market, i.e. normally higher than 200-500 dtex. Thanks to this method, elastic core yarns can be therefore obtained that are suitable for making elasticised fabrics which advantageously contain natural rubber instead of synthetic elastic threads besides cotton: therefore, these elasticised fabrics only contain environment-friendly materials, in particular, compostable materials. Accordingly, articles can be obtained that can be turned into compost, at the end of their useful life, or in any case they can be degraded naturally.

Moreover, such elasticised fabrics are particularly well-suited for skin-sensitive people, in comparison with synthetic polymer fibres, from which denim-type elasticised fabrics are usually manufactured.

As well known, the metric count Nm is an indirect measure of textile linear density (of the reciprocal thereof), and is defined as the number of kilometres corresponding to 1 Kg of a yarn or filament. In other words, the metric count is expressed in Km/Kg. An alternative textile linear density unit is tex, which is, inversely, the mass expressed in grams corresponding to 1 Km of a yarn or filament, or a submultiple thereof, such as dtex (0.1 tex).

The number of twists per metre means the number of twists that can be directly counted as the number of inverse torsions that are required for completely removing the twists on a predetermined length of a twisted yarn that has been arranged between two fixed points at a predetermined initial tensile stretch. In particular, the predetermined length and the initial tensile stretch are selected according to ISO 2061.

In particular, the predetermined minimum value $T_0$, for each linear mass density value Nm indicated in a respective line of table 1 is a value written in the same line, and in the column headed "$T_0$" of this table and, for values of said linear mass density Nm intermediate between values indicated in respective contiguous lines of the table, the minimum value $T_0$ is obtained by linearly interpolating the $T_0$ values written in the same adjacent lines of table 1 and in the column headed "$T_0$".

TABLE 1

| $N_m$ | $T_0$ | $T_1$ |
|---|---|---|
| 6 | 100 | 800 |
| 8 | 120 | 850 |
| 10 | 150 | 950 |
| 16 | 180 | 1000 |
| 25 | 200 | 1200 |
| 30 | 220 | 1300 |
| 36 | 250 | 1500 |
| 42 | 300 | 1600 |
| 50 | 350 | 1650 |
| 76 | 450 | 1900 |
| 100 | 500 | 2100 |

In particular, the predetermined maximum value $T_1$, for each linear mass density value Nm indicated in a respective line of table 1, is a value written in the same line, and in the column headed "$T_1$" of the table and, for values of said linear mass density Nm intermediate between values indicated in respective contiguous lines of the table, the maximum value $T_1$ is obtained by linearly interpolating the values $T_1$ written in the same adjacent lines of table 1 and in the column headed "$T_1$". With such a number of coils per unit length, a coil structure is obtained that is not too tightly packed to deteriorate the elastic properties of the elastic core yarn and, therefore, of any fabric manufactured therefrom.

The number T of coils per length unit, for each linear mass density value Nm, can be provided by the equation:

$$T=K\,Nm^{0.425};$$

where K is a number set between 75 and 290, which substantially correspond to said minimum and maximum values $T_0$ and $T_1$ of said number of wrapped coils, respectively.

Preferably, K is set between 90 and 250, more preferably, between 120 and 220.

Preferably, the number T of coils per length unit, is set between a central reference value $T_2$ minus 10% and the same central reference value $T_2$ plus 10%, wherein the central reference value $T_2$ is given in table 2 for some metric count values Nm, and is obtained by linearly interpolating the contiguous $T_2$ values for intermediate metric counts.

TABLE 2

| $N_m$ | $T_2$ |
|---|---|
| 6 | 300 |
| 8 | 300 |
| 10 | 450 |
| 16 | 500 |
| 25 | 650 |
| 30 | 700 |
| 36 | 700 |
| 42 | 700 |
| 50 | 800 |
| 76 | 900 |
| 100 | 950 |

The covering yarn can be a single-ply yarn, a double-ply yarn and a yarn having more than two plies.

Advantageously, the step of conveying the elastic core and the covering yarn up to the collecting spool comprises:

steps of causing the elastic core and the covering yarn to travel through a longitudinal through cavity and along a lateral surface, respectively, of a rotating hollow cylindrical body turning at a predetermined rotation speed, the longitudinal through cavity having an inlet end opening and an outlet end opening for the elastic core;

a step of causing the elastic core and said covering yarn to pass through an orifice facing the outlet end opening of the longitudinal through cavity of the hollow cylindrical body at a predetermined distance therefrom, and wherein the wrapping space is set between the outlet end opening and the orifice, such that the container has an outlet passageway at the orifice, and the elastic core and the covering yarn pass through the orifice as said elastic core yarn.

More in detail, the step of prearranging the source of the elastic core comprises the steps of prearranging a first spool of the elastic fibre, while the step of prearranging a covering yarn provides a step of mounting a second spool of covering yarn coaxially to the hollow cylindrical body. The step of conveying comprises a step of stretching and unwinding the elastic fibre from the first spool, at a predetermined unwinding speed equal to said conveying speed. The step of conveying also comprises a step of stretching the elastic core outside of the orifice, with the covering yarn wrapped about the elastic core, and a step of collecting the elastic core yarn on a third collecting spool, at a stretching/collecting speed selected in such a way to obtain a predetermined stretching ratio of the elastic fibre. In particular, this stretching ratio is set between 2 and 6.

In particular, the method can be actuated on a hollow spindle twisting machine, for instance, a Hamel-type machine allowing a protected balloon configuration, i.e. one in which the elastic core and the covering yarn are enclosed within a container when meeting to form the elastic core yarn.

In particular, the source of the elastic core can be a spool comprising a central hub having a rub radius and end flanges having a flange radius, the spool rotatably arranged about an own first axis, and the step of conveying the elastic core comprises a step of unwinding the elastic core from the spool. In this case, an intermediate balancing cylinder has a predetermined diameter longer than the flange radius shortened by the hub radius and a fixed own second axis parallel to the first axis is arranged between the spool and a motion distribution shaft parallel to the first and to the second axes, at contact with both the spool and the motion distribution shaft. This way, the elastic core is maintained in contact with the intermediate balancing cylinder during the step of unwinding.

Advantageously, the elastic fibre also comprises the following components:

a vulcanisation agent, wherein the vulcanisation agent is sulphur at a weight concentration in the natural rubber set between 0.5% and 3.0%;

a vulcanization accelerator and a vulcanization activator;

an anti-tacking agent;

an antioxidant agent;

a stabilisation agent, and the elastic fibre is obtained from a longitudinally cut flat yarn of the natural rubber, so as to obtain the elastic fibre in the form of an elastic filament having said linear mass density.

In an exemplary embodiment, the elastic core comprises a complementary thread arranged along the elastic fibre. This way, the friction between the coils of the covering yarn and the elastic fibre is remarkably reduced, which prevents slack, substantially inelastic deformities from forming in the fabric, due to poor elastic recovery, after stretching and then releasing a fabric portion, which often occurs in garments due to some wearer's movements or postures, or even when manufacturing such articles as garments from the elasticised fabric.

In this case, the step of prearranging a source of an elastic core comprises a step of prearranging a fourth spool of the complementary thread, and the step of conveying the elastic core involves the complementary thread along with the elastic fibre, from the respective first and fourth spool, wherein a friction wheel is provided to which the elastic fibre and the complementary thread converge, before being conveyed together to the wrapping space.

In particular, the complementary thread is made of a biodegradable material that can be selected, for instance, from the group consisting of: wool, silk, cotton, flax, hemp, jute, sisal, raffia and ramiè.

The complementary thread can be a discontinuous thread or a continuous thread. In the latter case, it can be arranged parallel to the elastic fibre, or can be interconnected to it, i.e. connection points can be provided between the complementary thread and the elastic fibre at predetermined distance from one another, or can be wrapped about the elastic fibre, for instance, forming a covering about it. The continuous complementary thread can be a single-filament continuous thread or a multiple-filament continuous thread, in which case the filaments can be flat or textured. Preferably, the complementary thread has a metric count set between 22 dtex and 150 dtex.

It falls within the scope of the invention also an elasticised yarn obtained according to the method described above, as well as an elasticised fabric containing at least one part of the above described elasticised yarn, obtained by the method described above.

BRIEF DESCRIPTION OF THE DRAWINGS

The invention will be now shown with the following description of its exemplary embodiments, exemplifying but not limitative, with reference to the attached drawings, in which:

FIGS. 3 and 4 are diagrammatical side views of an unwinding unit for unwinding the elastic fibre of a twisting element, the unwinding unit comprising an intermediate balancing cylinder;

FIG. 5 shows the unwinding unit FIGS. 3 and 4 in three different instants of the unwinding step, i.e. at the beginning (a), at the end (c) and in an intermediate instant (b) of the unwinding step;

DESCRIPTION OF PREFERRED EXEMPLARY EMBODIMENTS

Figure 1:
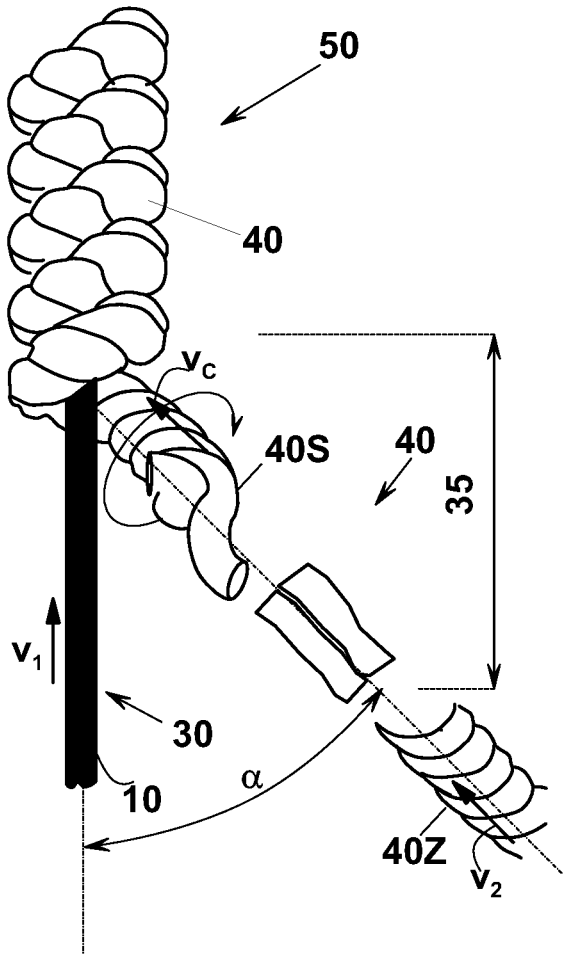
FIG. 1 diagrammatically shows a step of helically wrapping the covering yarn about the elastic core comprising an elastic fibre to obtain an elasticized yarn in the form of an elastic core yarn.

With reference to FIG. 1, a method is described for making an elastic core yarn 50, wherein an elastic core 30 is coated by a covering yarn 40 helically arranged about elastic core 30. The method provides a step of prearranging elastic core 30, which comprises an elastic fibre 10 made of natural rubber, and typically having a linear mass density set between 200 dtex and 1000 dtex. The method also comprises a step of prearranging a cotton-based covering yarn 40 that has a metric count Nm and is twisted with a predetermined initial twist direction, which can be "Z" or "S", and typically "Z", as normally available in the trade.

Elastic core yarn 50 is obtained by a step of covering by helically wrapping covering yarn 40 about elastic core 30. In order to accomplish the wrapping, steps are provided of conveying elastic core 30 and covering yarn 40 at respective speeds $v_1$ and $v_2$, to a wrapping space 35, where covering yarn 40 laterally i.e. tangentially attains elastic core 30, covering yarn 40 at a predetermined angle $\alpha$ with respect to elastic core 30 when attaining the latter, so as to form a substantially helical covering about elastic core 30.

Figure 2:
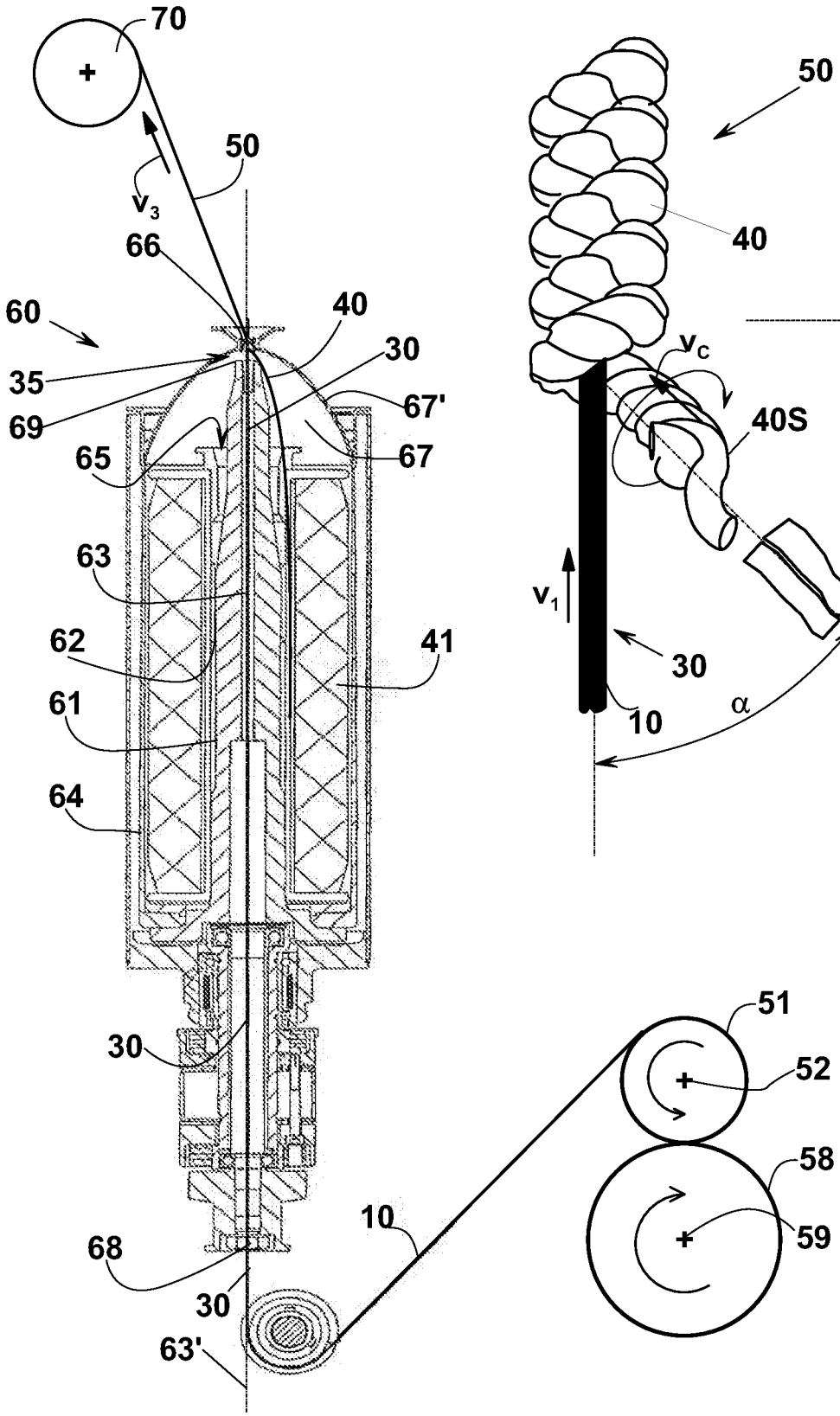
FIG. 2 diagrammatically shows a device for carrying out the step of helically wrapping the covering yarn about the elastic core, in an exemplary embodiment.

Wrapping space 35 is a normally closed space, as shown in FIG. 2, so that covering yarn 40 is turned from a substantially linear arrangement, when entering into wrapping space 35, to a helically wrapped arrangement, in a reduced-turbulence environment, in order to limit the friction of elastic core 30, of covering yarn 40 and of yarn 50 with air, during the wrapping step.

As also shown in FIG. 2, the steps of conveying elastic core 30 and covering yarn 40 are controlled by a speed $v_3$ at which elastic core yarn 50 is collected on a collecting spool 70. As a consequence, covering yarn 40 and elastic fibre 10 are withdrawn from respective sources, which can be such storage devices as spools 41, 51.

As also shown in FIG. 2, in an exemplary embodiment, the step of conveying elastic core 30 towards wrapping space 35 is carried out through a central longitudinal through cavity 63 of a first cylindrical body 61 arranged to quickly rotate, at a predetermined rotation speed, about its own axis 63', then elastic core 30 is conveyed along a substantially linear path. Instead, the step of conveying covering yarn 40 is carried out along an outer surface 62 of first cylinder 61, preferably along a guide element arranged thereon, not shown. Preferably, first cylindrical body 61 is housed integrally and coaxially within a second hollow cylinder 64, creating a conveying unit 60. Spool 41 of covering yarn 40 is integrally arranged within second cylindrical body 64, such that the step of conveying covering yarn 40 takes place in a gap 65 between spool 41 and the outer surface of first cylindrical body 61.

In this exemplary embodiment, wrapping space 35 is defined between an outlet end 69 of first cylindrical body 61, at which elastic core 30 is delivered, and an orifice 66 that is preferably arranged along axis 63', from which elastic core yarn 50 is released in a stretched condition, to be in turn conveyed to collecting spool 70. The covering of wrapping space 35 is made by a preferably axisymmetric wall 67' converging from an inner surface of second hollow cylindrical body 64 to orifice 66, thus creating a container 67, of which orifice 66 is an outlet passageway for elastic core yarn 50 formed within wrapping space 35.

Conveying speeds $v_1$ and $v_2$ (FIG. 1) of elastic core 30 and covering yarn 40, respectively, as well as the rotation speed of conveying unit 60, are selected in such a way that, in the step to helically wrapping covering yarn 40 about elastic core 30, covering yarn 40 changes its own twist direction, for instance from "Z" to "5", and in other words becomes twisted with a final twist direction opposite to an initial twist direction, turning from a Z-twisted covering yarn 40Z into an S-twisted covering yarn 40S. Moreover, speeds $v_1$ and $v_2$ are selected in such a way that a number T of coils set between a predetermined minimum value $T_0$ and a predetermined maximum value $T_1$ is wrapped about each length unit of newly-manufactured elastic core yarn 50, maximum and minimum values $T_0$,$T_1$ depending on metric count Nm of covering yarn 40.

Source 51 of elastic core 30 can be a spool 51 of elastic fibre 10 rotatably arranged about its own axis 52 and comprises a central hub 53 and end flanges 54 of radius R, at end portions of central hub 53 of radius r, as shown in FIG. 4. Spool 51 is moved by a motion distribution shaft 58, i.e. a cylinder 58 that is rotatably arranged about an own rotation axis 59 throughout an array of aligned twisting units of a twisting machine. To this purpose, rotation axis 59 of motion distribution shaft 58 is parallel to (common) rotation axis 52 of (each) spool 51, and motion distribution shaft 58 is arranged in contact with the free surface of unwinding elastic fibre 10, as also shown in FIG. 2, in order to cause spool 51 to rotate at a prefixed rotation speed.

In a preferred embodiment of the invention, as shown in FIGS. 3 to 5, an intermediate balancing cylinder 56 is arranged between motion distribution shaft 58 and spools 51 of elastic fibre 10 of the twisting units, with its own axis 57 parallel to axis 52 of spools 51 and axis 59 of motion distribution shaft 58. More in detail, intermediate balancing cylinder 56 is freely rotatably arranged in contact with the surface of motion distribution shaft 58, on one side, and in contact with the surface of spool 51, on another opposite side, i.e. it is arranged in contact with the free surface of unwinding elastic fibre 10. Cylinder radius P of intermediate balancing cylinder 56 is longer than flange radius R, shortened by hub radius r, i.e. the relationship $$P>R-r$$

is verified.

Axis 52 of spool 51 is slidingly arranged along a guide 55 integral to the spinning machine. This way, as the unwinding step progresses, the amount of elastic fibre 10 on spool 51 decreases, and therefore axis 52 along with spool 51 progressively approach intermediate balancing cylinder 56 and therefore approach motion distribution shaft 58, as shown in FIG. 5. In a vertical arrangement of the unwinding unit, in which spool 51 is arranged above motion distribution shaft 58 as in FIGS. 3 and 4, the relative approach movement of spool 51 and intermediate balancing cylinder 56 is possible due to gravity acting on spool 51. In other cases, but preferably also in this case, a spring means, not shown, can be advantageously provided for progressively recalling spool 51 to motion distribution shaft 58 as the step of unwinding elastic fibre 10 progresses.

Therefore, as shown in FIG. 5, while being unwound, elastic filament 10 is always withdrawn from spool 51 at a same distance L=S+2P, regardless the unwinding state of coil 51, where S (FIG. 3) is the radius of motion distribution shaft 58. This way, no periodic adjustments of tensile force acting on elastic fibre 10 are required to maintain the stretching ratio of elastic fibre 10 at a fixed value, preferably between 2 and 6, and to maintain the number of coils actually wrapped about the core at a fixed value, provided winding speed $v_3$ is maintained at a fixed value, gradually as the step of unwinding progresses.

The material of the covering yarn is a cotton-based material based on cotton, in particular it contains at least 50% cotton. For instance, this material can be a material normally used for making a denim fabric. The cotton-based covering yarn can be a single-ply yarn, a double-ply yarn or even a yarn having more than two plies.

Figure 6:
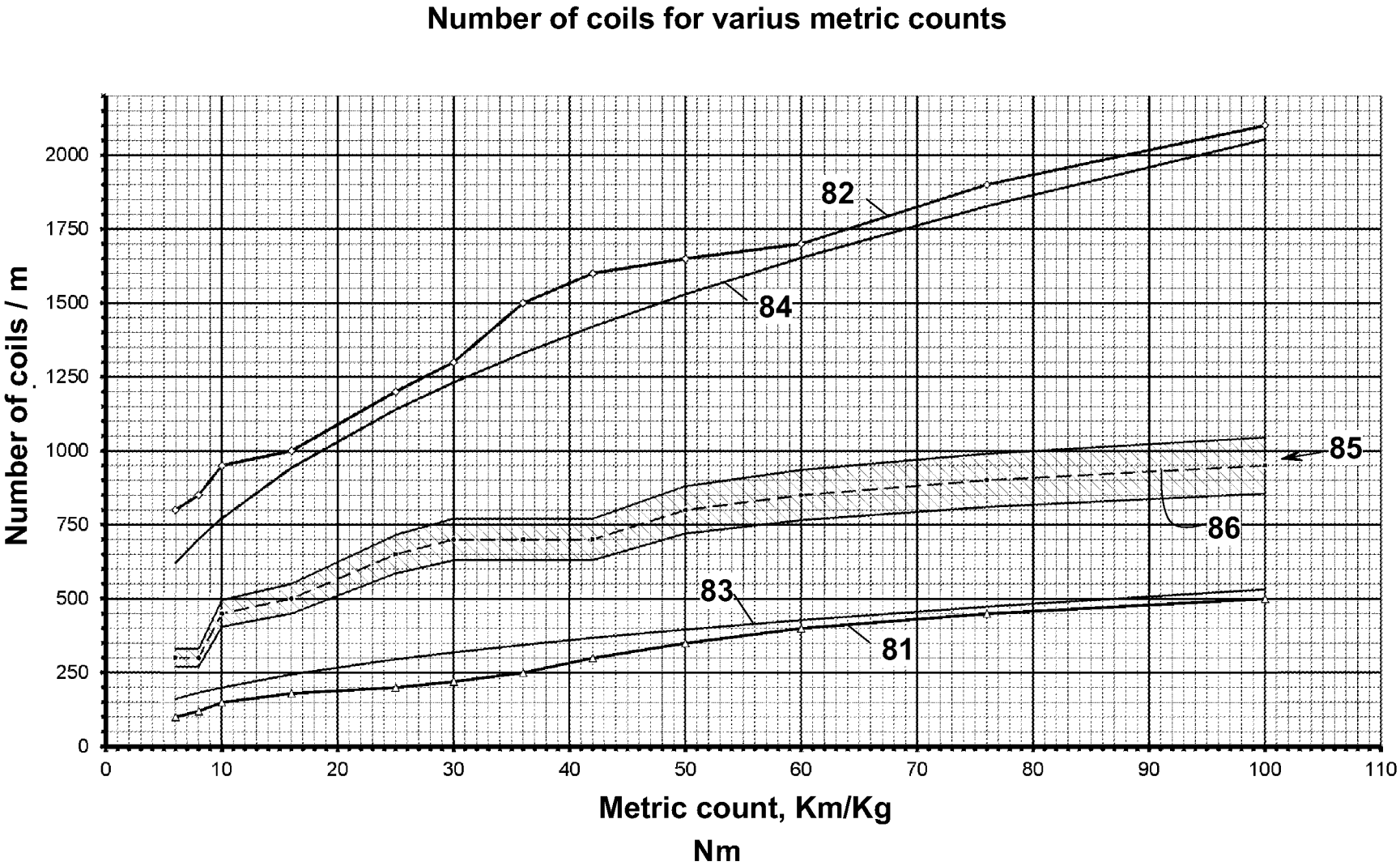
FIG. 6 is a diagram showing how the minimum, maximum, reference number of coils depend on the metric count of the covering yarn.

FIG. 6 is a diagram showing the predetermined minimum value $T_0$ of number T of coils to be wrapped about a length unit of elastic core yarn 50 being manufactured, for each linear mass density value Nm of covering yarn 40, in the form of a curve 81. Curve 81 is obtained by interpolating the values of the middle column of table 1.

The diagram of FIG. 6 also shows a curve 82 indicating, for each linear mass density value Nm of covering yarn 40, a maximum number $T_1$ of coils that can be wrapped without losing the elastic properties of elastic core yarn 50, as experience has shown. Curve 82 is obtained by interpolating the values of the right column of table 1.

Advantageously, the number T of coils per length unit of elastic core yarn 50, for each value Nm of metric count of covering yarn 40, is provided by the equation:

$$T=K\,Nm^{0.425};$$

where K is a number set between 75 and 290, these values substantially corresponding to curves 83 and 84 of the diagram of FIG. 6. More in particular, K can be set between 90 and 250, more in particular, between 120 and 220.

The diagram of FIG. 6 also shows a band 85 corresponding to preferred values T of number of coils per length unit, set between ±10% a central reference value $T_2$ that is obtained by interpolating the values of table 2, corresponding to curve 86.

Figure 8:
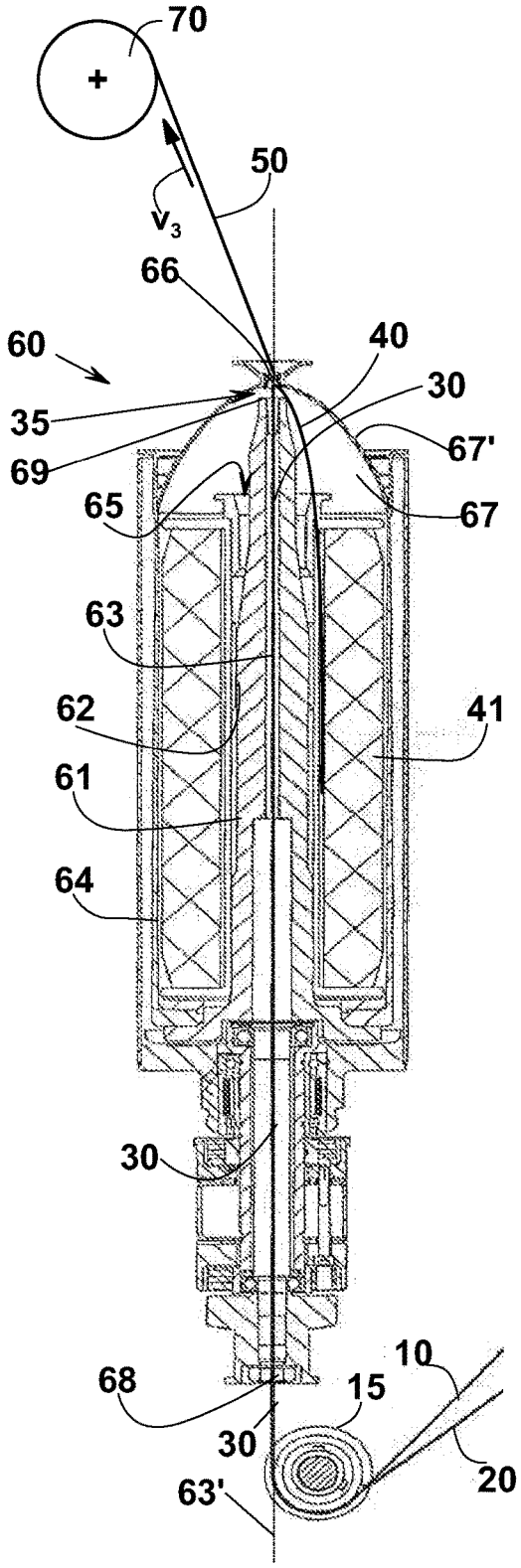
FIG. 8 diagrammatically shows a device for carrying out the step of helically wrapping the covering yarn about the elastic core of FIG. 7.
Figure 7:
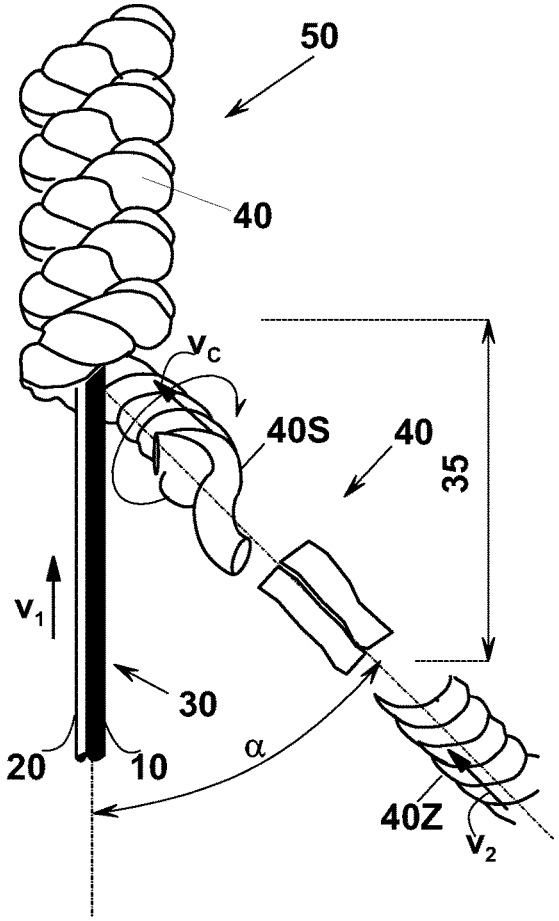
FIG. 7 diagrammatically shows a step of helically wrapping the covering yarn about an elastic core comprising a complementary thread in addition to the elastic fibre.

With reference to FIGS. 7 and 8, elastic core 30 can also comprise a complementary thread 20 arranged along elastic fibre 10. In this case, the step of prearranging elastic core 30 provides steps of prearranging a fourth spool, not shown, of complementary thread 20, and the step of conveying the elastic core involves, besides elastic fibre 10, also complementary thread 20. A friction wheel 15 can also be provided to which elastic fibre 10 and complementary thread 20 converge, before being conveyed together into central longitudinal through cavity 63, through an inlet opening 68 thereof, of first cylindrical hollow object 61.

Preferably, complementary thread 20 is made of a biodegradable or compostable material that can be, for instance, wool, silk, cotton, flax, hemp, jute, sisal, raffia, ramiè.

Complementary thread 20 can be a discontinuous or continuous filament, in the latter case it can be a single-filament continuous thread or a multiple-filament continuous thread. The filament or the filaments thereof can be flat or textured filaments.

Still in the case of a continuous complementary thread 20, FIG. 7 only shows a substantially parallel arrangement, in which complementary thread 20 and elastic fibre 10 are parallel to each other. However, the invention is not limited by this exemplary embodiment, since different arrangements between complementary thread 20 and elastic fibre 10 are possible, such as a wrapped arrangement, in which complementary thread 20 forms a covering about elastic fibre 10, as well as an interconnected arrangement, in which connection point are provided between complementary thread 20 and elastic fibre 10, at predetermined distance from each other.

It falls within the scope of the present patent application an elastic core yarn manufactured by the method described above, also an elasticised fabric containing such an elastic core yarn.

The foregoing description exemplary embodiments of the invention will so fully reveal the invention according to the conceptual point of view, so that others, by applying current knowledge, will be able to modify and/or adapt for various applications the embodiments without further research and without parting from the invention, and, accordingly, it is therefore to be understood that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. A method for making an elastic core yarn comprising the steps of:

prearranging a source of an elastic core comprising an elastic fiber made of a natural rubber containing more than 80% of cis-1,4-polyisoprene, wherein said elastic fiber has an elastic fiber linear mass density set between 200 dtex and 1000 dtex;

prearranging at least one covering yarn comprising cotton at a weight percentage higher than 50%, wherein said covering yarn has a covering yarn linear mass density set between 6 Nm and 100 Nm, said covering yarn prearranged with an initial twist direction selected between "Z" and "S";

conveying said elastic core and said covering yarn up to a collecting spool, at a predetermined elastic core conveying speed and at a predetermined covering yarn speed, respectively, wherein:

said elastic core conveying speed ranges from an initial elastic core conveying speed, at said source of elastic core, to a final elastic core conveying speed at least twice said initial elastic core conveying speed, at said collecting spool, and wherein said step of conveying is carried out in such a way that said covering yarn laterally attains a proximity of said elastic core in a wrapping space; and helically wrapping said covering yarn about said elastic core in said wrapping space, thus obtaining said elastic core yarn;

wherein:

said elastic core conveying speeds and said covering yarn conveying speed are selected in such a way that, in said step of helically wrapping:

said covering yarn becomes twisted with a final twist direction opposite to said initial twist direction;

a number T of coils of said covering yarn set between a predetermined minimum value $T_0$ and a predetermined maximum value $T_1$, said minimum and maximum values $T_0$,$T_1$ depending upon said covering yarn linear mass density, is wrapped about one length unit of said elastic core yarn, and said wrapping space is a protected space enclosed by a container.

2. The method according to claim 1, wherein, in said step of helically wrapping, said covering yarn becomes twisted with said final twist direction opposite to said initial twist direction in such a way that said predetermined minimum value $T_0$ and said predetermined maximum value $T_1$ depend upon said covering yarn linear mass density as indicated in a respective line of the following table:

TABLE 1

| $N_m$ | $T_0$ | $T_1$ |
|---|---|---|
| 6 | 100 | 800 |
| 8 | 120 | 850 |
| 10 | 150 | 950 |
| 16 | 180 | 1000 |
| 25 | 200 | 1200 |
| 30 | 220 | 1300 |
| 36 | 250 | 1500 |
| 42 | 300 | 1600 |
| 50 | 350 | 1650 |
| 76 | 450 | 1900 |
| 100 | 500 | 2100 |

wherein for values of said covering yarn linear mass density Nm intermediate between values indicated in respective contiguous lines of said table, said minimum and maximum values $T_0$, $T_1$ are obtained by linearly interpolating the values written in said respective contiguous lines and in the columns headed by $T_0$ and $T_1$ of said table, respectively.

3. The method according to claim 2, wherein said number T of coils per length unit, for each value of said covering yarn linear mass density Nm, has a value provided by the equation:

$$T=KNm^{0.425};$$

where K is a number set between 75 and 290.

4. The method according to claim 3, wherein K is set between 90 and 250.

5. The method according to claim 3, wherein K is set between 120 and 220.

6. The method according to claim 1, wherein said covering yarn is selected among a single-ply yarn, a double-ply yarn and a yarn having more than two plies.

7. The method according to claim 1, wherein said step of conveying said elastic core and said covering yarn up to said collecting spool comprises:

steps of causing said elastic core and said covering yarn to travel through a longitudinal through cavity and along a lateral surface, respectively, of a rotating hollow cylindrical body turning at a predetermined rotation speed, said longitudinal through cavity having an inlet end opening and an outlet end opening for said elastic core; and a step of causing said elastic core and said covering yarn to pass through an orifice facing said outlet end opening of said longitudinal through cavity of said hollow cylindrical body at a predetermined distance therefrom, wherein said wrapping space is set between said outlet end opening and said orifice, such that said container has an outlet passageway at said orifice and said elastic core and said covering yarn pass through said orifice as said elastic core yarn.

8. The method according to claim 1, wherein:

said source of said elastic core is a spool comprising a central hub having a hub radius (r) and end flanges having a flange radius (R), said spool rotatably arranged about an own first axis, said step of conveying said elastic core comprises a step of unwinding said elastic core from said spool, an intermediate balancing cylinder having a predetermined radius (P) longer than said flange radius shortened by said hub radius has a fixed own second axis parallel to said first axis, and is arranged at contact between said spool and a motion distribution shaft parallel to said first and second axes, and during said step of unwinding, said elastic core is maintained in contact with said intermediate balancing cylinder.

9. The method according to claim 1, wherein said elastic fiber also comprises the following components:

a vulcanization agent, wherein said vulcanization agent is Sulphur at a weight concentration in said natural rubber set between 0.5% and 3.0%;

a vulcanization accelerator and a vulcanization activator;

an anti-tacking agent;

an antioxidant agent; and a stabilization agent, wherein said elastic fiber is obtained from a longitudinally cut flat yarn of said natural rubber, so as to obtain said elastic fiber in the form of an elastic filament having said elastic fiber linear mass density.

10. The method according to claim 1, wherein said elastic core comprises a complementary thread arranged along said elastic fiber.

11. The method according to claim 10, wherein said complementary thread is made of a biodegradable material.

12. The method according to claim 11, wherein said biodegradable material is selected from the group consisting of: wool, silk, cotton, flax, hemp, jute, sisal, raffia and ramie.

13. The method according to claim 10, wherein said complementary thread is a continuous thread having an arrangement along said elastic fiber selected from the group consisting of:

a parallel arrangement, wherein said complementary thread is arranged parallel to said elastic fiber;

an interconnected arrangement, wherein said complementary thread has connection points to said elastic fiber, said connection points arranged at a predetermined distance from each other; and a wrapped arrangement, wherein said complementary thread forms a covering about said elastic fiber.

14. The method according to claim 13, wherein said complementary thread is selected between a single-filament continuous thread and a multiple-filament continuous thread comprising flat or textured filaments.

15. An elastic core yarn made by the method according to claim 1.

16. An elasticised denim fabric containing the elastic core yarn according to claim 15.

17. An elastic core yarn made by the method according to claim 2.

18. An elasticised denim fabric containing the elastic core yarn according to claim 17.

19. An elastic core yarn made by the method according to claim 7.

20. An elasticised denim fabric containing the elastic core yarn according to claim 19.

* * * * *